United States Patent [19]

Schweiss et al.

[11] Patent Number: 4,993,187

[45] Date of Patent: Feb. 19, 1991

[54] RELEASABLE WINDOW GUARD ASSEMBLY

[75] Inventors: Kenneth K. Schweiss, Wyoming; Charles D. Flack, Jr.; Harold E. Flack, II, both of Dallas, all of Pa.; Lawrence P. Simms, New York, N.Y.

[73] Assignee: Exeter Architectural Products, Inc., Wyoming, Pa.

[21] Appl. No.: 421,344

[22] Filed: Oct. 13, 1989

[51] Int. Cl.[5] ..... E06B 3/68

[52] U.S. Cl. ..... 49/56; 49/55; 49/67; 49/257

[58] Field of Search ..... 49/50, 56, 67, 142, 49/254, 257, 55, 57

[56] References Cited

U.S. PATENT DOCUMENTS

| | | | |
|---|---|---|---|
| 1,192,406 | 7/1916 | Fair | 49/67 X |
| 1,278,502 | 9/1918 | Plummer | 49/254 X |
| 3,788,689 | 1/1974 | Lloyd | 49/254 X |
| 3,832,805 | 9/1974 | Stevens | 49/56 X |
| 4,294,040 | 10/1981 | Crotti | 49/254 |
| 4,384,428 | 5/1983 | Cox | 49/57 X |
| 4,593,492 | 6/1986 | Lumenello | 49/55 X |
| 4,624,072 | 11/1986 | Zilkha | 49/55 |
| 4,630,396 | 12/1986 | Zvi et al. | 49/55 |
| 4,679,353 | 7/1987 | Langenbach et al. | 49/254 X |
| 4,791,762 | 12/1988 | Hwang | 49/449 X |

*Primary Examiner*—Gary L. Smith
*Assistant Examiner*—Jerry Redman
*Attorney, Agent, or Firm*—Michael Ebert

[57] ABSTRACT

A window guard screen and frame assembly installable on the jamb of a building window to prevent unauthorized access therethrough. The assembly screen is fabricated from a single sheet of metal having folded-in margins to define channel-like upper and lower end branches and right and left side branches bordering a planar field that is perforated in a predetermined pattern to admit light and air. The planar frame is dimensioned to overlie or nest within the window jamb and is secured to the walls or face of the jamb by adjustable brackets. Integral with the inner surface of the frame and surrounding the opening therein is a slideway socket for receiving the screen, the socket being defined by upper and lower end legs and right and left side legs. One side branch of the socketed screen is hinged at its extremities to the upper and lower end legs of the socket by hinge pins slidable in slots formed in these legs whereby the screen is horizontally slidable from a security mode position in which it is confined to the socket and the window is guarded, to an access mode position in which the screen is free to swing out from the frame opening to permit one to exit through the then unguarded window. A releasable latch is provided which engages the other side branch of the screen and is accessible only from the building inside to lock the socketed screen in its security mode position. When released, the latch permits the screen to be slid to the access mode position.

14 Claims, 4 Drawing Sheets

A

Bd
17
18
10

Ld
Fd
11
22
22P
12
21
20
Fc
Bc
Lc
13
W
28
26
25
24
27
23

RELEASABLE WINDOW GUARD ASSEMBLY

BACKGROUND OF INVENTION

1. Field of Invention

This invention relates generally to window guards to prevent unauthorized access to a building through its windows, and more particularly to a releasable window guard screen and frame assembly whose hinged screen is fabricated from a single sheet of metal and may be swung out of the frame opening to permit exit from the building through the window.

2. Status of Prior Art

It is common practice to protect the windows of a building, especially those on the ground floor level, from unauthorized entry by means of window guards or grills. Often used for this purpose is a guard formed by a framed mesh screen of heavy gauge wire, making it difficult for an intruder to cut the mesh. A wire mesh screen or one made of expanded metal not only prevents intruders from gaining access to the building through the guarded windows, but also serves to shield these windows against breakage.

A permanently-installed window guard has a number of disadvantages, the primary drawback being that in the event of a fire or other emergency, it is not possible to leave the building through the guarded window. One must therefore find another way to escape, and this may not then be available. Another disadvantage of a framed wire mesh screen is that, in time, the screen may become loose or detached from its frame and hence cease to be effective.

Another factor that must be taken into account in window guard design is the extent to which the screen cuts down the amount of light and ventilating air admitted therethrough, as well as the degree to which it reduces visibility. With heavy gauge and relatively thick wire mesh screens, there is a marked reduction in the amount of admitted light and air, and visibility is hindered by the thickness of the screen, particularly when looking through the mesh-guarded window at an oblique angle.

Quite apart from these practical limitations is the fact that wire mesh screen or expanded metal window guards are unappealing from the aesthetic standpoint, for a building having such purely utilitarian window guards presents a prison or factory-like appearance. Thus, an otherwise architecturally attractive school building which is a source of pride to the community may be rendered far less presentable should wire mesh screens be installed to guard the windows.

It is also common practice to provide window guards with releasable locking mechanisms which when unlatched permit the screen to be removed or to swing out, thereby permitting exit through the window in case of fire or other emergency.

The ideal locking mechanism for a window guard is one which can be quickly unlatched without difficulty in the event of an emergency, but which when latched makes it very difficult to remove or to swing out the screen, and therefore affords a high degree of security. Prior art locking mechanisms for window guards are either relatively complicated and difficult to release quickly, or of a simple mechanical design that not offer a high degree of security.

One must also take into account in window guard design the need for repair and maintenance, for in time it may be necessary to replace the screen, to paint it or to lubricate the moving parts. With complicated window guards of the prior art type, these parts may be inaccessible or difficult to remove for purposes of maintenance and repair. Window guards are subjected to weathering, and conventional guards whose hinges and other key components are exposed, may as a result of rusting or painting, become difficult go open.

Yet another factor that comes into play when the window guard is of the type in which a screen is supported by a frame attached to the window jamb is that should there exist even a small gap between the screen and the frame, this makes it possible for an intruder to insert a tool in this gap to pry open the screen.

The Pellicore Pat. No. 2,924,862 shows a window guard for school houses and other applications in which the guard fits within the window jamb. The window guard comprises a welded steel frame formed of a channel member which supports a woven wire mesh. Also provided is a releasable locking means so that the window guard can be opened quickly in the event of an emergency.

The Levin Pat. No. 2,711,565 shows a window guard in the form of a main frame secured to the window opening, to which is hinged a closure frame supporting a wire mesh, locking means being provided. Kelly, 3,087,750, shows a window guard in which a framed woven-wire mesh screen is hinged to the side of a window, a lock being provided. These prior art mesh screen arrangements suffer from many of the drawbacks previously discussed.

The Fernandez Pat. No. 4,634,157 shows a window guard in which bars are supported by a rectangular frame to provide a guard which presents a prison-like appearance. Also prison-like is the bar assembly shown in Pat. No. 4,771,574 to Stephens, in which a grid formed by bars is held within a frame. Even more prison-like are the window grill of Warwick, 4,796,384 and the window guard of Hicks et al., 4,685,316. The patent to Merry, 4,677,789, shows a window guard in which a frame is secured to a window opening, to which is hinged an inner frame having a grate attached thereto.

The Hatvany Pat. No. 4,566,222 discloses a one-piece window guard formed of a sheet of metal or plastic having cutouts therein to provide light and ventilation. The side margins of the sheet are rolled to form cylindrical rims, one receiving a hinge bolt and the other a locking bolt. The hinging rim and the locking rim are attached by angle irons to window wall studs.

Hatvany points out that window guards provided with locking mechanisms which can be released from the inside of a building often include springs, flexible cables and other parts which, once installed, are inaccessible for inspection, cleaning, lubrication or replacement, and that should these mechanisms jam in an emergency situation, the consequences may be serious. Hatvany therefore provides a less complicated release mechanism for his window guard.

However, the Hatvany arrangement must be custom tailored to a window jamb of given dimensions in a complicated, costly, through-wall installation, and cannot be fitted into a jamb whose dimensions differ somewhat from the jamb for which it is designed.

None of the prior art window guards satisfies all of the practical and aesthetic requirements mentioned previously which must be taken into account in the design of a window guard that can, without modification, be fitted into window jambs that vary somewhat in their dimensions.

SUMMARY OF INVENTION

In view of the foregoing, the main object of the invention is to provide an easily-releasable window guard assembly installable on the jamb of a building window to prevent unauthorized access to the building through the window, the same assembly being installable in window jambs whose dimensions differ somewhat from window-to-window.

More particularly, an object of this invention is to provide a window guard assembly whose screen is fabricated from a single sheet of relatively thin metal perforated in a predetermined pattern to admit light and ventilating air, the pattern being aesthetically pleasing to render the installation attractive.

Also an object of the invention is to provide a window guard assembly whose screen is hingedly-supported on a planar frame attachable by adjustable brackets to the wall of a window jamb, the brackets making it possible to mount the planar frame on jambs that from window-to-window vary somewhat in their dimensions, whereby the same assembly may be installed on all windows in the building without the need to custom fit the assembly.

A significant feature of the invention is that no gap exists between the single piece screen and the planar frame on which it is supported, thereby obviating the danger of the screen being pried open by a tool inserted in a gap. Another advantage of the invention is that the screen can easily be detached from the frame for purposes of maintenance or repair.

Also an object of the invention is to provide an assembly of the above type having a single releasable latch to permit the screen to be swung out of the frame, which latch is accessible only from the interior of the building.

A salient feature of the invention resides in its safety, for the quick-release latch on the unit expedites fast and sure egressin a dark, smoke-filled room or under other emergency conditions, and there is no searching for keys or fumbling with a lock combination.

Yet another object of the invention is to provide a window guard assembly that presents an attractive appearance and affords a high degree of security, yet can be manufactured at relatively low cost.

Briefly stated, these objects are attained in a window screen and frame guard assembly installable on the jamb of a building window to prevent unauthorized access therethrough. The assembly screen is fabricated from a single sheet of metal having folded-in margins to define channel-like upper and lower end branches and right and left side branches bordering a planar field that is perforated in a predetermined pattern to admit light and air. The planar frame dimensioned to overlie or nest within the window jamb and is secured to the wall of the jamb by adjustable brackets.

Integral with the inner surface of the frame and surrounding the opening therein is a slideway socket for receiving the screen, the socket being defined by upper and lower and right and left side legs. One side branch of the socketed screen is hinged at its extremities to the upper and lower end legs of the socket by hinge pins slidable in slots formed in these legs whereby the screen is horizontally slidable from a security mode position in which it is confined to socket and the window is guarded, to an access mode position in which the screen is free to swing out from the frame opening to permit exit from the building through the then unguarded window. A releasable latch is provided which engages the other side branch of the screen and is accessible only from inside the building to lock the screen in its security mode position. The latch, when released, permits the screen to be slid to the access mode position.

BRIEF DESCRIPTION OF DRAWINGS

For a better understanding of the invention as well as other objects and further features thereof, reference is made to the following detailed description to be read in conjunction with the accompanying drawings, wherein.

DETAILED DESCRIPTION OF INVENTION

Figure 2:
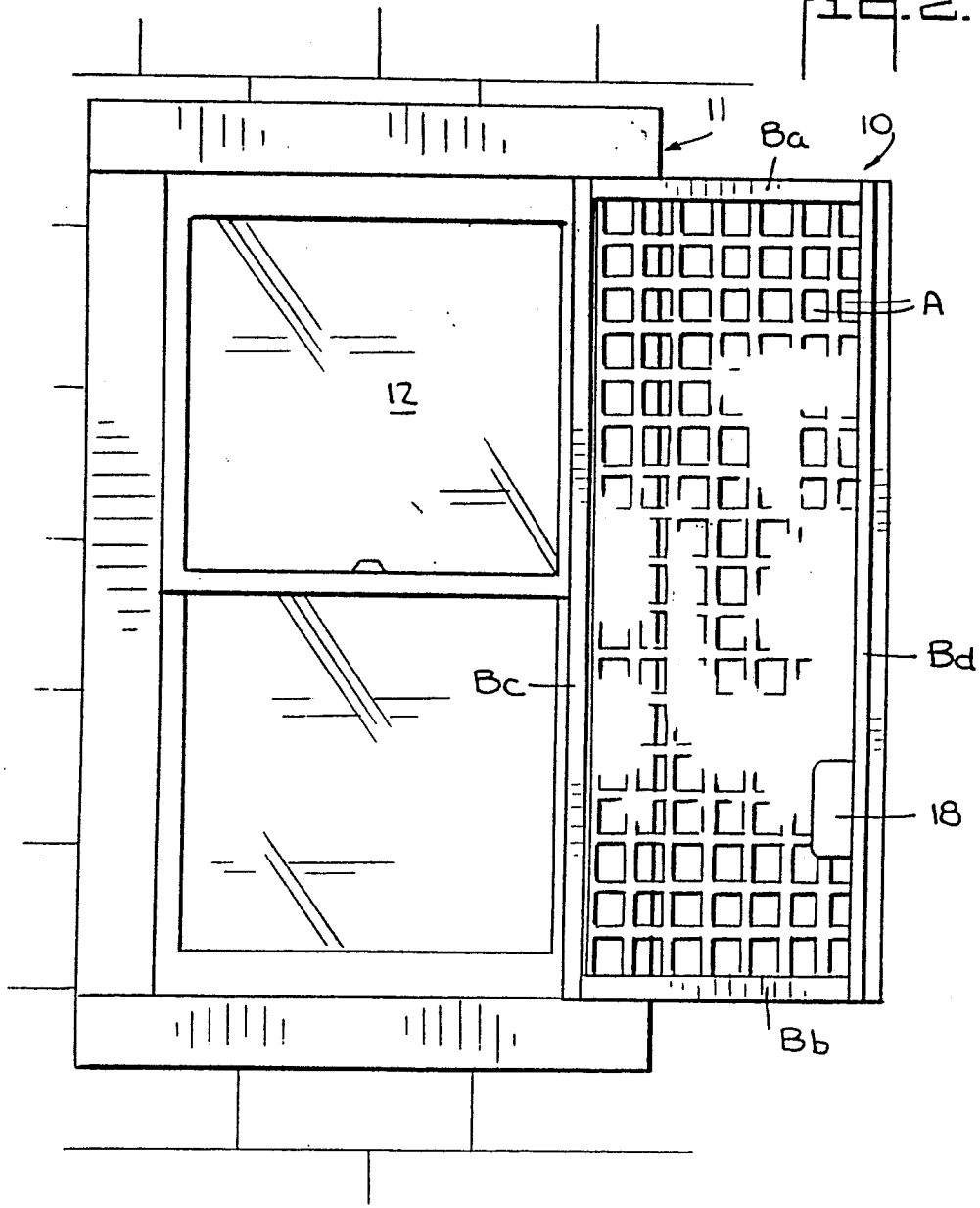
FIG. 2 is the same as FIG. 1, except that in this figure the assembly is shown in its access mode with the screen swung out from the frame of the assembly to permit exit from the building through the then unguarded window.
Figure 1:
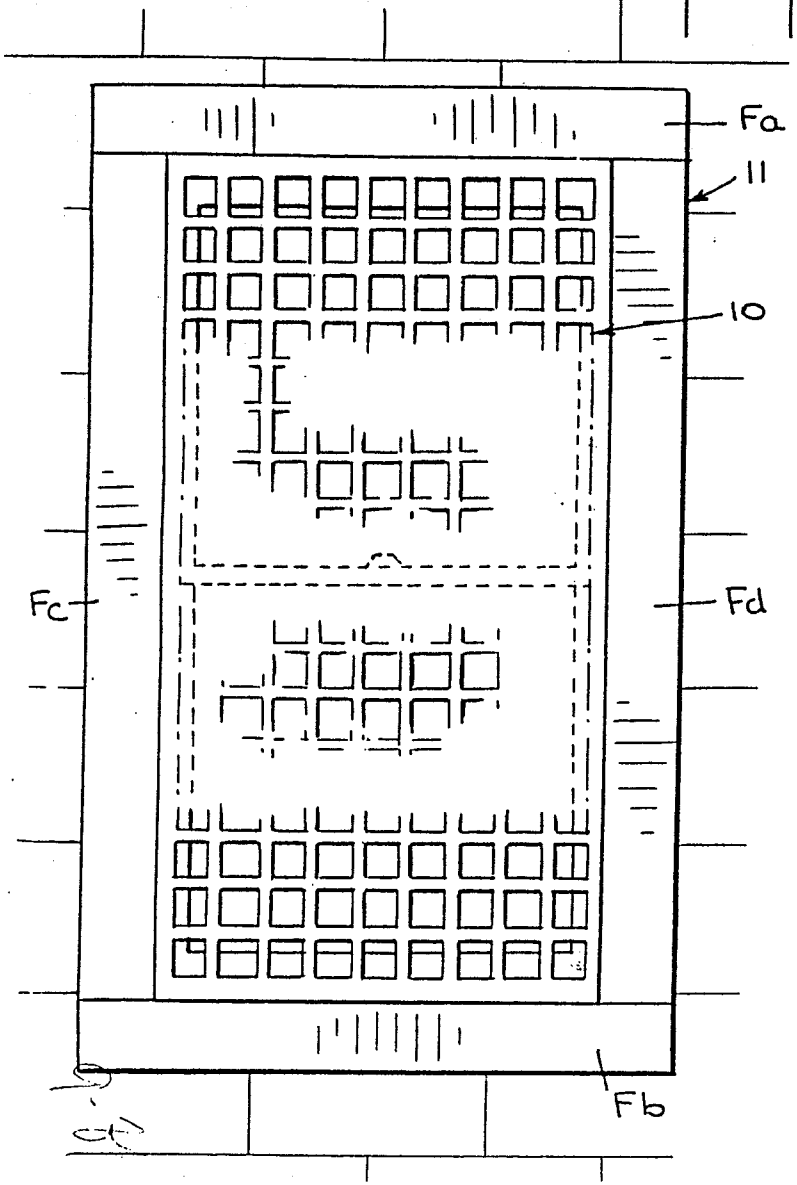
FIG. 1 illustrates a window guard assembly according to the invention installed on the window jamb of a building, the assembly being shown in its security mode to prevent unauthorized access to the building through the guarded window.

It will be seen in FIGS. 1 and 2 that a releasable window guard assembly according to the invention has two main components: a metal screen identified generally by numeral 10, and a planar metal frame identified generally by numeral 11 behind whose rectangular opening the screen normally lies.

There are two modes of operation: a security mode as shown in FIG. 1, in which window 12 on or in whose jamb the assembly is installed is guarded, and an access mode as shown in FIG. 2 in which the window is unguarded. In the security mode, intrusion is prevented, while in the access mode, one may exit from the unguarded window in the event of a fire or other emergency.

In the security mode, screen 10, whose front surface is planar, lies against the rear surface of planar frame 11 and is blocked thereby, so that virtually no gap exists therebetween which would permit an intruder to insert a tool to pry open the screen. The planar frame lies flat against the exterior wall of the building, and since the front surface of the screen is virtually co-planar with the frame, the installed assembly is altogether free of bolts, ridges, or other protrusions, and therefore presents a clean, uncluttered appearance compatible with the architecture of the building. Alternatively, frame 11 may be dimensioned to nest within the window opening and to be flush with the facade of the building.

The screen, which is hinged to the frame, is provided with a latch to maintain it in its security mode. The rectangular opening of the frame has a height that matches that of the screen and a width somewhat smaller than that of the screen, so that it can only be swung out of the opening when angled with respect thereto. It is then possible in the access mode to swing out the screen and to open window 12 and exit therefrom. Also in this mode, one can clean the outside of window 12 and all parts of the assembly.

Figure 3:
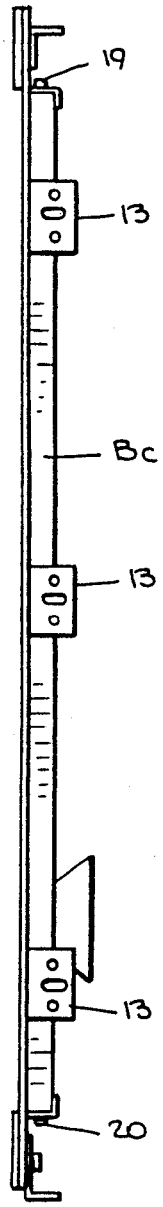
FIG. 3 is an end view of the assembly.
Figure 4:
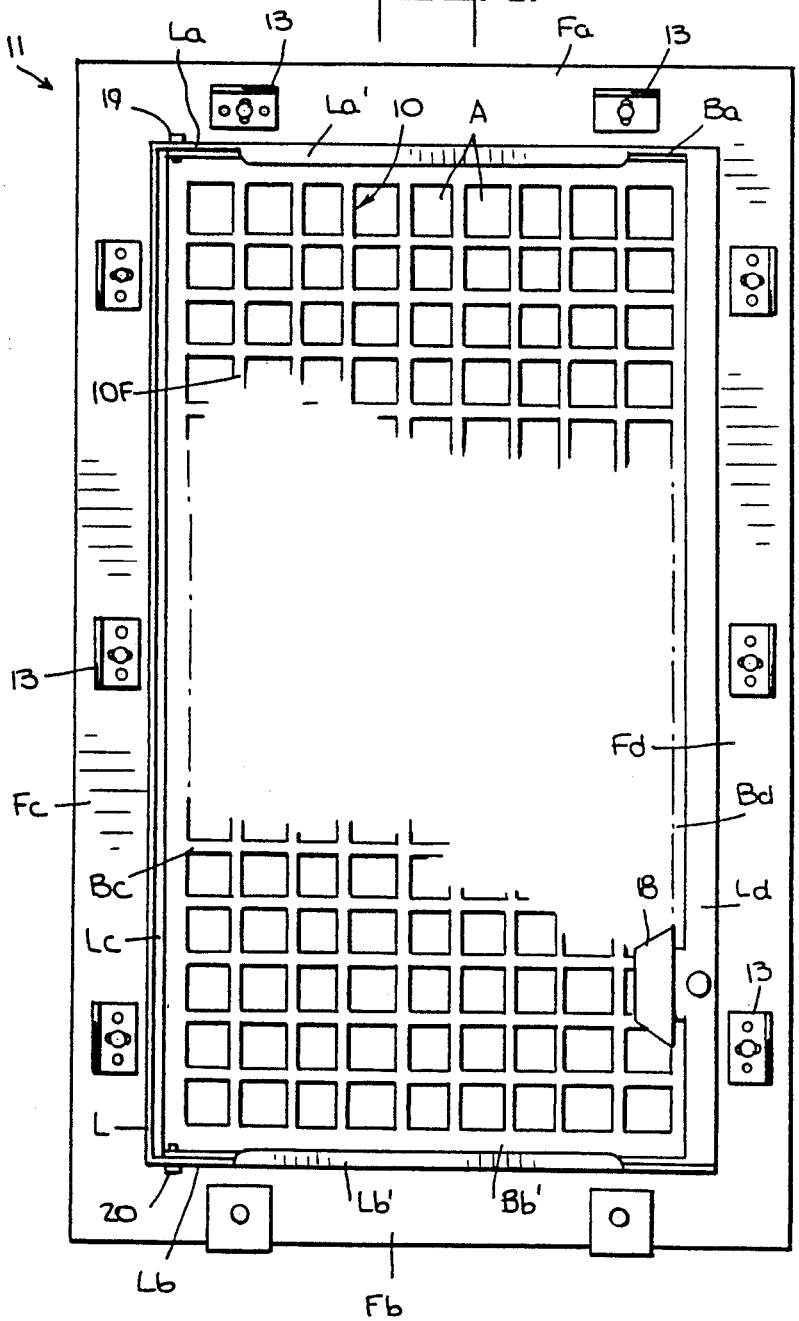
FIG. 4 is a rear elevation view of the assembly.

As shown in FIGS. 3 and 4, frame 11, which is preferably formed of steel, is constituted by upper and lower end metal plates Fa and Fb and right and left side plates Fc and Fd which are welded together to form the frame behind whose rectangular opening lies screen 10 which in the security mode lies parallel to frame 11 and is blocked thereby. Attached to the inner surface of the frame plates are right-angle or L-shaped brackets 13, a spaced pair of brackets being provided for each plate. Alternatively, frame 11 may be formed of a single rectangular sheet of metal to which the brackets are attached.

Figure 5:
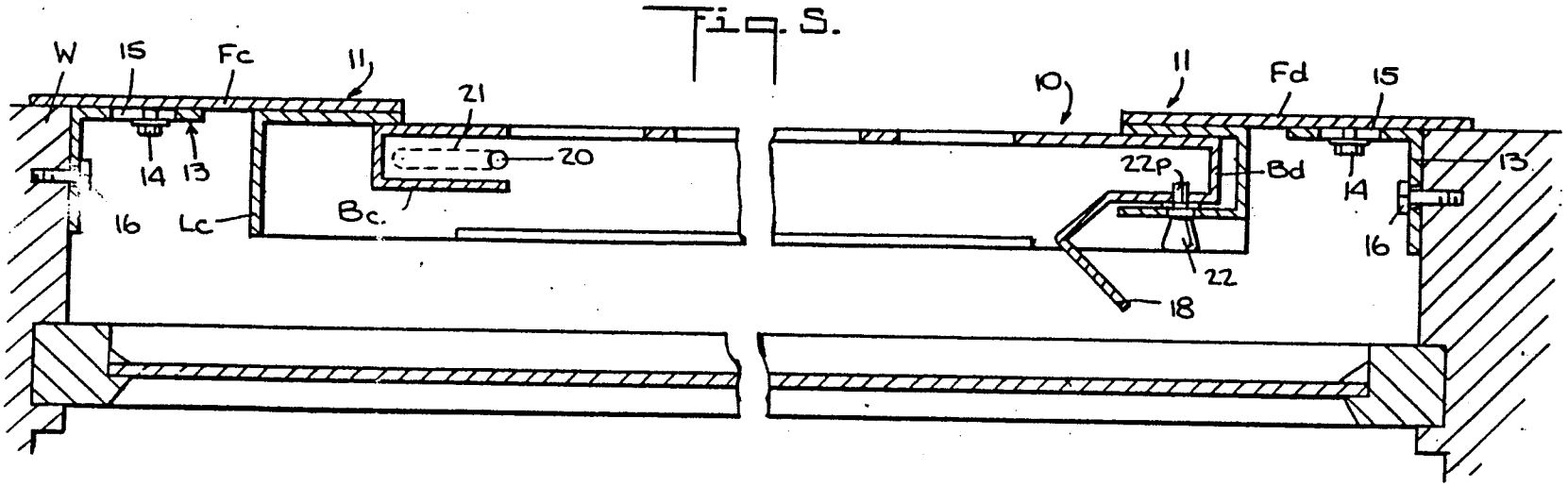
FIG. 5 is a transverse section taken through the installed assembly which is shown in the security mode with the screen latched.
Figure 6:
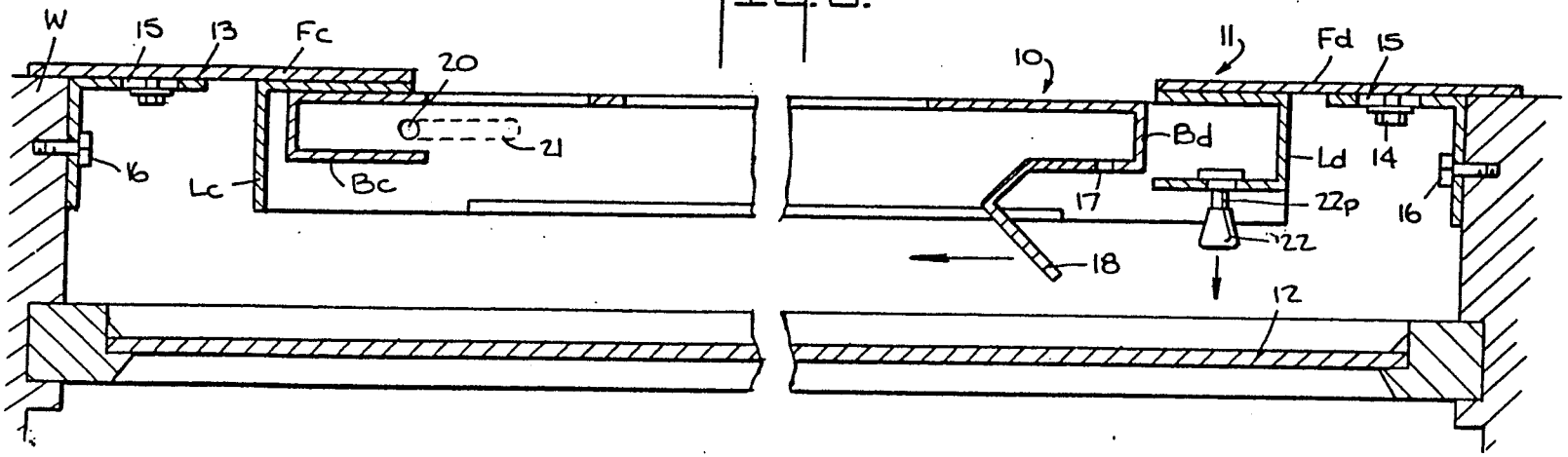
FIG. 6 is the same as FIG. 5, except that the assembly is shown in the access mode in which the screen is unlatched.

As shown in FIGS. 5 and 6, brackets 13, which are adjustable, serve to secure the frame to the corresponding end and side walls W of the jamb for window 12. One arm of each bracket is attached to a frame plate by a bolt 14 that passes through an elongated slot 15 in this arm. The other arm of each bracket is secured to a jamb wall W by a bolt 16 which passes through a slot in this arm. In practice, depending on the material from which the jamb is fabricated, a suitable anchor may be wedged in a hole drilled in the wall, such as a masonry anchor, to threadably receive the mounting bolt. Because of slot 15, the position of each bracket 13 is adjustable within the slot limits relative to the related frame plate, the bracket offering two adjustment ranges by reason of the slots in the arms thereof.

Typically, though window jambs in a building are nominally identical in their dimensions, they actually vary somewhat from window to window. Also, some of the jambs may be out of square. But because brackets 13 are shiftable relative to the frame plates, the same assembly may be conformed to jambs that vary somewhat in their dimensions, thereby avoiding the need to custom-tailor the assemblies to the jambs.

As best seen in FIG. 4, which is a rear view of the assembly, and in FIGS. 5 and 6, which are transverse sections of the assembly, screen 10 is fabricated from a single sheet of high strength metal such as steel whose margins are folded in to define channel-shaped branches, each having a U-shaped cross section. The upper and lower end branches of screen 10 are identified as branches Ba and Bb, while the right and left side branches are identified as branches Bc and Bd. These branches are welded together at the corners of the screen to provide a screen, which even though fabricated of thin metal, is highly resistant to flexure.

Screen branches Ba to Bd border a planar field 10F that is perforated to provide apertures A that admit light and ventilating air. But because the screen is thin, it does not markedly reduce visibility when one looks through the screen at an oblique angle. In contradistinction, in the case of a relatively thick mesh screen formed of woven wire, of expanded metal or similar material, one experiences a sharp loss in visibility, for at an oblique angle, a thick screen tends to block the view.

Perforations A in planar field 10F, are in a predetermined pattern dictated in good part by aesthetic considerations. Thus instead of a uniform pattern of rectangular apertures as shown in FIG. 4, the pattern may be such as to define an array of apertures divided into geometric zones by unapertured bands in a criss-cross or grid formation to produce casement window or other decorative effects to enhance the attractiveness of the assembly.

Figures 7, 8, 9:
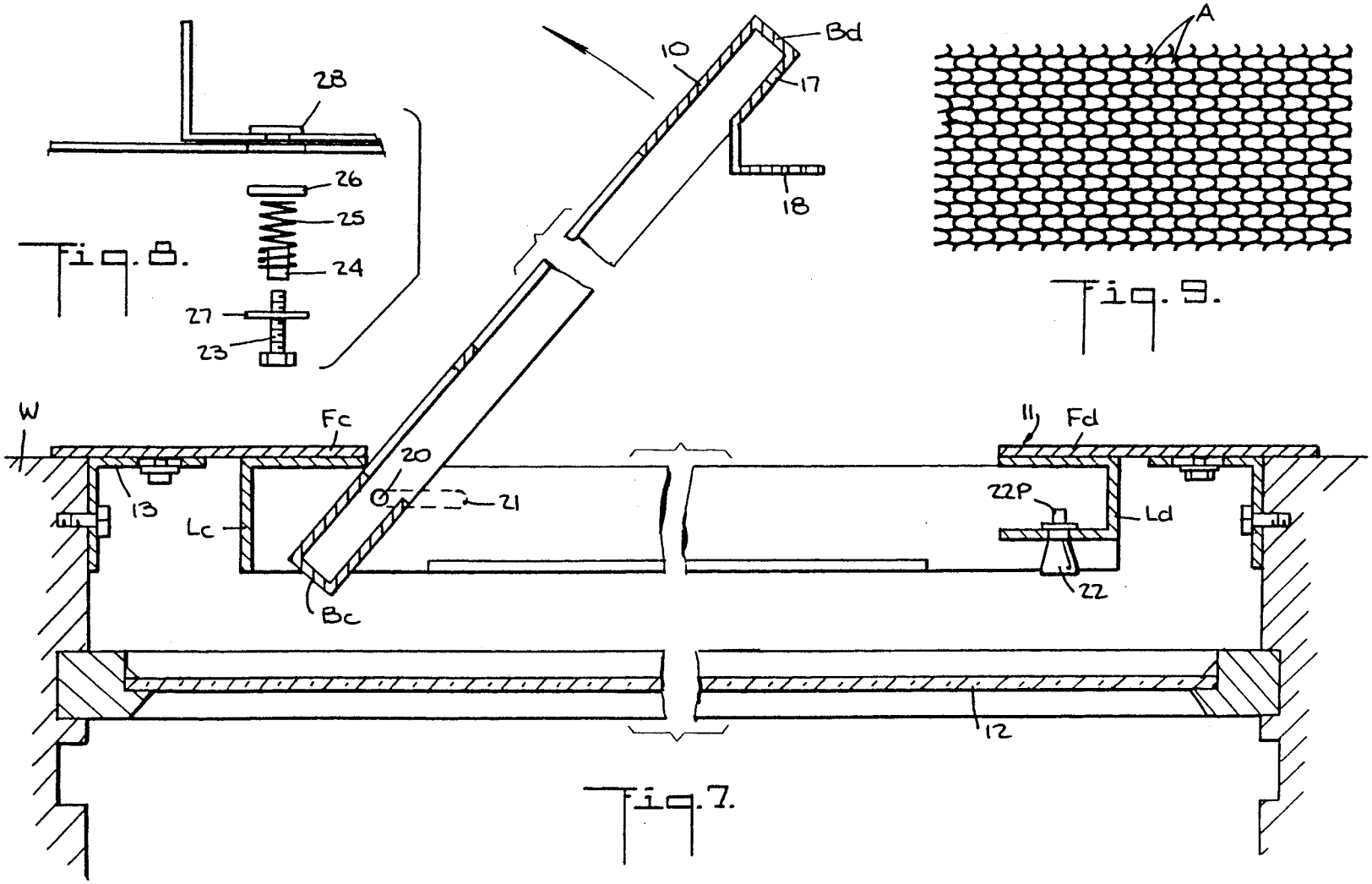
FIG. 7 is the same as FIG. 6 except that the screen of the assembly in its access mode is swung out from the frame opening, so that one may now open the window and exit therefrom.
FIG. 8 is an exploded view of the pivot pin assembly.
FIG. 9 shows another preferred pattern of screen perforations.

In the pattern of screen apertures shown in FIG. 9, the apertures are in staggered rows, each row being formed by a series of oblong apertures A in overlapping relation, so that the pattern is free of straight lines as in the grid-like pattern shown in FIG. 4. It has been found that the optical effect produced by the FIG. 9 pattern is such as to enhance visibility, in that the absence of straight vertical and horizontal lines under certain circumstances effectively erases the presence of the screen, or at least reduces the viewer's awareness of the screen.

The effect of the FIG. 9 pattern is comparable to that produced by a theatre scrim that is dropped over the front of a highly illuminated stage being viewed by an audience in a darkened theatre. When the audience views the stage through the pores of the screen, they are not conscious of the screen but only of its effect in softening the image of the actors; for when the scrim is raised, the actors are then more sharply seen.

With the FIG. 9 aperture pattern, an individual in a room who looks out through the apertured screen of the guard assembly to a sun-illuminated scene, is then not conscious of the screen, except that when the screen is swung out of the way, the scene is more brightly illuminated.

Screen 10, as best seen in FIGS. 4, 5 and 6, is received within a slideway socket formed on the rear of frame 11. The socket is defined by upper and lower legs La and Lb, and right and left legs Lc and Ld welded or otherwise integrated with the corresponding frame plates Fa to Fd. Upper leg La, as shown in FIG. 4, is provided with a turned-in flange La', and lower leg Lb is provided with a similar flange Lb'.

These flanges act as a barrier to prevent screen 10, which is hinged to the socket as well as being slidable therein, from swinging inwardly, the screen being permitted only to swing outwardly through the frame opening. Alternatively, these fixtures can be reversed for interior installation, so that the screen is then adapted to open inwardly, not outwardly. Where the objective is detention, not security, a guard having a security screen which pivots inwardly and is released from the exterior is then useful for this purpose.

Right side leg Lc of the socket is flangeless, whereas left side leg Ld is channel-shaped to accommodate the correspondingly-shaped side branch Bd of screen 10. Mounted on left side leg Ld of the socket is a releasable latch 22 whose pin 22P enters a hole 17 in the corresponding side branch Bd of the screen to prevent sliding movement of the screen in the security mode of the assembly, as shown in FIG. 5.

When, as shown in FIG. 6, latch pin 22P is retracted from hole 17, screen 10 is then free to slide toward right side leg Lc of the socket so that side branch Bd of the screen is no longer confined in the left side leg Ld. This represents the access mode of the assembly in which the screen can now be angled and swung out of the rectangular opening of the frame.

Attached to the left side branch Bd of the screen at a position adjacent to latch 22 in side leg Ld is a shaped metal shield 18. This acts as a barrier to prevent an intruder outside the building from inserting a tool through the apertured screen to engage and release the latch. It also acts as a handle to facilitate sliding of the screen in the socket. Preferably, the hand/shield is made from stainless steel and incorporates a 45 degree bend to deflect drill bits inserted by an intruder through the screen.

As shown in FIGS. 3 and 4, screen 10 is hinged at the extremities of its right side branch Bc to the upper and lower legs La and Lb of the frame socket by hinge pins 19 and 20. The hinge pins pass through an elongated slot 21 in these legs. Thus when the screen is made to slide in the slideway socket, the hinge pins borne by the screen slide in slots 21 which limit the extent of slide. FIG. 5 shows hinge pin 20 at one end of slot 21 in the security mode of the assembly, while FIG. 6 shows pin 20 at the other end of slot 21 in the access mode in which the screen can now be angled with respect to the assembly and swung out on the hinge pins.

In practice, the hinge pins are preferably spring-biased and in a form that can easily be disassembled should one wish to remove the screen from the frame socket for replacement or maintenance. Thus as shown in FIG. 8, the hinge pins may take the form of a threaded bolt 23 which receives a sleeve 24 surrounded by a helical spring 25, the spring being held between upper and lower washers 26 and 27. The hinge pin assembly is held together by a nut 28. In practice, the hinge pins may be of the cotter or any other type.

As shown in FIG. 7, in the access mode, screen 10 pivoted on hinge pin 20 is swung out of the frame opening, so that one can then exit from the building through window 12. The assembly is rattle-free in the security mode, side branch Bd of the screen being nested within leg Ld of the frame socket.

It is a simple matter to unlatch the screen, for all that is necessary is to pull out latch 22. Yet though simple, the latch is highly effective, for by pulling out the latch, one is not able to then swing out the screen, for to do so, one must first slide the screen to disengage its side branch Bd from the side leg Ld of the socket.

In practice, a spring assembly may be provided to apply tension or compression to either the hinge side or the latch side of the screen as an opening assist mechanism to effect lateral displacement of the screen when the latch is released. This feature is useful for large and relatively heavy screens. Thus one could use a leaf-spring in the latch-side channel under compression or coil-springs on the hinge-side in tension. The springs will work to assist the operator in sliding the screen away from the latch until it is clear of the frame retainer and may then be swung open.

A narrow space between the screen and the upper and lower legs of the retaining socket within which the screen is slidable is unavoidable. As a consequence, the hinge pins coupling these legs and the upper and lower branches of the socket extend through this space, and it would be possible with an appropriate tool for an intruder to insert this tool into this narrow space and saw through the hinge pins. But when the screen in its security mode position is latched, even if the hinge pins are cut, it would still be impossible to remove the screen from its confining socket, for to do so, one must first slide the screen, and this cannot be done without first releasing the latch which is not accessible to the intruder.

In practice, in addition to a hole in one of the side legs of the socket and a hole in the corresponding branch of the screen to accommodate the latch mechanism, one may provide at least one secondary set of holes to accommodate a padlock or other secondary lock mechanism, where such is desirable for high security purposes. But in school buildings and in similar installations, to discourage students from opening the screen, thereby compromising safety, a plastic tamper seal may be provided that goes through the secondary set of holes, but which can be pulled off when necessary.

Instead of a "pull" type latch mechanism, this mechanism can be of the "push" type or of the side-operating type. Because of the branched character of the screen, its channels may be used to accommodate a Lexan window to render it bullet proof, or a storm window, or an insect screening.

In practice, the entire unit can be so oriented on installation as to permit the hinged screen to open either to the right or left, or up or down. After this choice is made, the latch and handle are installed at the site at appropriate positions, multiple holes being provided in the unit to accommodate this choice.

The apertures in the screen may be rectangular, circular or in any other geometric or free-form shape, provided that the intersticial webs retain adequate substance and strength to afford the desired degree of security, and that the apertures are small enough to obstruct the entry of implements seeking to compromise or operate the egress mechanism.

While there has been shown and described a preferred embodiment of a releasable window guard assembly in accordance with the invention, it will be appreciated that many changes and modifications may be made therein without, however, departing from the essential spirit thereof. Thus while the assembly has been shown as a window guard, in practice it may be dimensioned to function as a door guard or as a guard for any type of opening.

We claim:

1. A releasable screen and frame assembly mountable on the jamb of a window to prevent an intruder from gaining access to a building through the window, the screen when released permitting exit from the building through the window, the assembly comprising:

(a) a screen fabricated from a single sheet of metal whose margins are folded in to define upper and lower end branches and right and left side branches, which branches border a planar filed that is perforated in a predetermined pattern to admit light and air;

(b) a planar metal frame dimensioned to overlie or nest within the jamb of the window and being attachable to the walls of the jamb, said frame defining a rectangular opening whose height matches that of the screen and whose width is smaller than that of the screen whereby the screen can only swing out from the opening when the screen assumes an angle with respect thereto;

(c) a slideway socket including upper and lower legs formed on the rear surface of the frame and surrounding the opening to accommodate the screen; and (d) hinge pins slidable in the upper and lower end legs to hinge the screen at its upper and lower end branches to the socket whereby the screen is slidable from a security mode position wherein it lies parallel to the frame and is blocked thereby to guard the window, to an access mode position in which the hinged screen can be caused to assume an angle with respect to the opening and swung out therefrom to permit exit through the window.

2. An assembly as set forth in claim 1, in which the screen branches have a U-shaped channel formation.

3. An assembly as set forth in claim 2, in which the branches are welded together at the corner of the screen to render the screen resistant to flexure.

4. An assembly as set forth in claim 2, wherein said socket is formed by upper and lower end legs and right and left side legs, one of said side legs having a channel-shaped form to receive the corresponding side branch of the screen in the security mode.

5. An assembly as set forth in claim 4, wherein the upper and lower legs of the sockets are each provided with an inturned flange which acts as a barrier to prevent the screen in the access mode from swinging inwardly.

6. An assembly as set forth in claim 4, wherein the other side branch of the screen is hinged at its extremities by said hinge pins to the upper and lower legs of the slideway socket which have slots therein to permit sliding movement of the screen.

7. An assembly as set forth in claim 6, wherein said hinge pins are spring-biased.

8. An assembly as set forth in claim 4, further including a releasable latch mounted on said one of said side legs and having a retractable pin insertable in a hole in the corresponding side branch of the screen to retain the screen in its security mode.

9. An assembly as set forth in claim 8, wherein said corresponding side branch has a shaped shield attached thereto and extending therefrom to deny access to the latch from the exterior of the building through an aperture in said screen.

10. An assembly as set forth in claim 1, whose screen and frame are fabricated of steel.

11. An assembly as set forth in claim 1, wherein said pattern of perforations is constituted by a uniform array of small rectangular apertures.

12. An assembly as set forth in claim 1, wherein said pattern of apertures if formed by staggered rows each formed by a series of overlapping oblong apertures.

13. An assembly as set forth in claim 1, wherein said frame is attachable to the walls of the jamb by adjustable right-angle brackets to accommodate the frame to jambs that from window-to-window vary somewhat in their dimensions.

14. An assembly as set forth in claim 13, wherein each bracket is formed by first and second arms at right angles to each other, each arm having an elongated slot therein to receive a fastening element.

* * * * *

UNITED STATES PATENT AND TRADEMARK OFFICE

CERTIFICATE OF CORRECTION

PATENT NO. : 4,993,187

DATED : February 19, 1991

INVENTOR(S) : Kenneth K. Schweiss et al.

It is certified that error appears in the above-identified patent and that said Letters Patent is hereby corrected as shown below:

Column 8, line 47, "filed" should read --field--

Signed and Sealed this

Thirteenth Day of October, 1992

*Attest:*

*Attesting Officer*

DOUGLAS B. COMER

*Acting Commissioner of Patents and Trademarks*